343-909 SR
3/4/86 XR 4,574,288

United States Patent [19]

Sillard et al.

[11] Patent Number: 4,574,288

[45] Date of Patent: Mar. 4, 1986

[54] PASSIVE ELECTROMAGNETIC WAVE DUPLEXER FOR MILLIMETRIC ANTENNA

[75] Inventors: Gilles Sillard; Michel Baril, both of Paris, France

[73] Assignee: Thomson CSF, Paris, France

[21] Appl. No.: 411,958

[22] Filed: Aug. 26, 1982

[30] Foreign Application Priority Data

Aug. 28, 1981 [FR] France ..... 81 16467

[51] Int. Cl.[4] ..... H01Q 19/10

[52] U.S. Cl. ..... 343/781 P; 343/909

[58] Field of Search ..... 343/781 P, 768, 767, 343/781 R, 781 CA, 909

[56] References Cited

U.S. PATENT DOCUMENTS

| | | | |
|---|---|---|---|
| 2,761,137 | 8/1956 | Van Atta et al. | 343/785 |
| 2,820,220 | 1/1958 | Charman | 343/767 |
| 2,982,960 | 5/1961 | Shanks | 343/767 |
| 3,245,008 | 4/1966 | Manwarren | 343/781 P |
| 3,274,601 | 9/1966 | Blass | 343/781 |
| 3,317,860 | 5/1967 | Garver | 333/13 |
| 3,969,729 | 5/1976 | Nemit | 343/768 |

*Primary Examiner*—Eli Lieberman
*Assistant Examiner*—Karl Ohralik
*Attorney, Agent, or Firm*—Cushman, Darby & Cushman

[57] ABSTRACT

A passive duplexer for electromagnetic waves operated within the millimetric wave range. The duplexer comprises a first horn associated with a radar transmitter and having a propagation axis ($\Delta_1$), a plane circular grid inclined at 45° with respect to ($\Delta_1$), and a second horn associated with the radar receiver and having an axis ($\Delta_2$) at right angles to ($\Delta_1$). The grid is formed by a network of resonant slots equipped with at least one diode.

9 Claims, 12 Drawing Figures

FIG_1
(PRIOR ART)
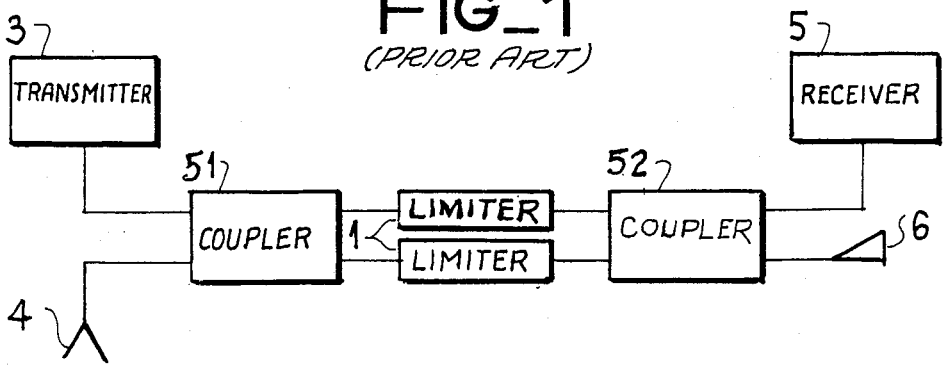
FIG_2-a (PRIOR ART)
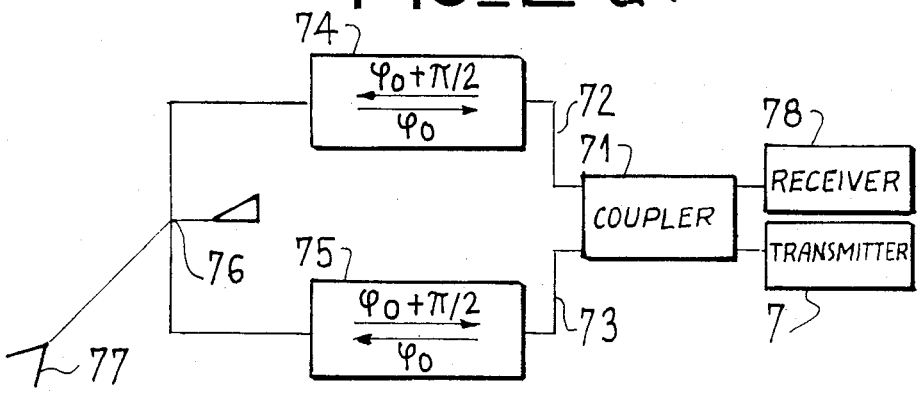
FIG_2-b
(PRIOR ART)
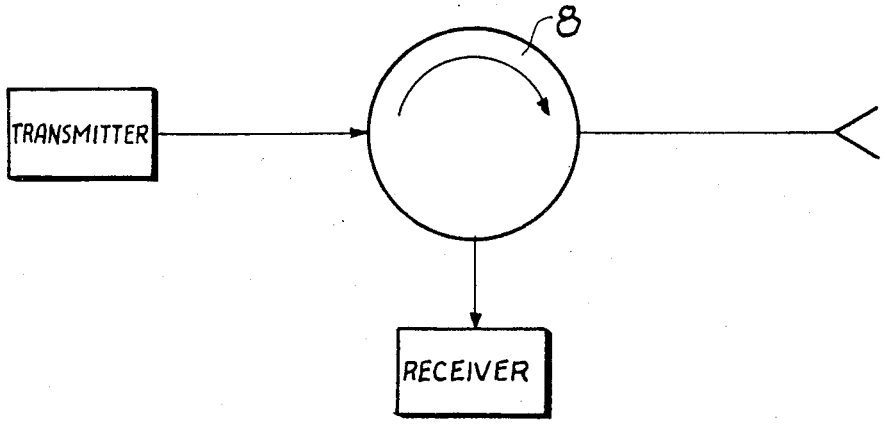

FIG_4
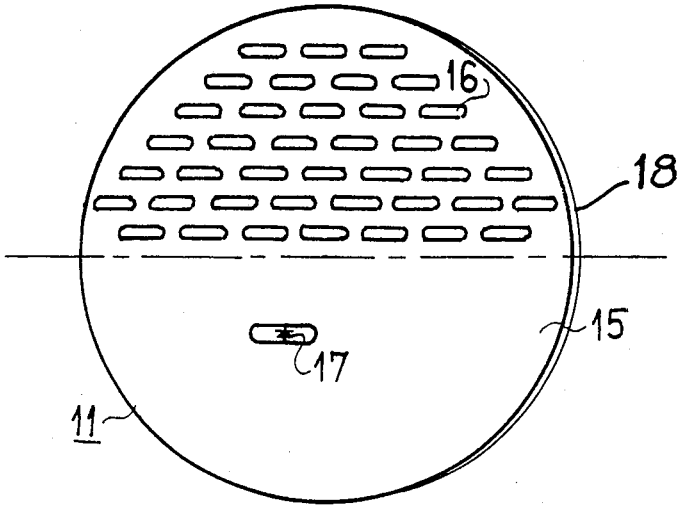
FIG_5-a
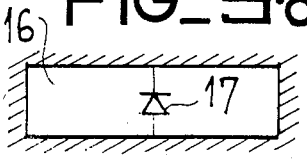
FIG_5-b
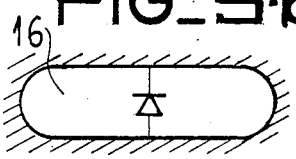
FIG_5-c
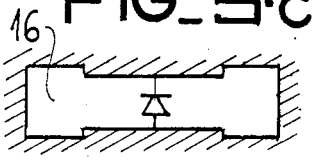
FIG_6-a
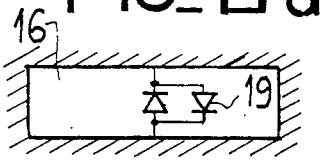
FIG_6-b
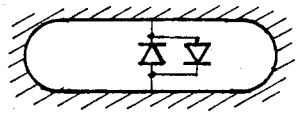
FIG_6-c
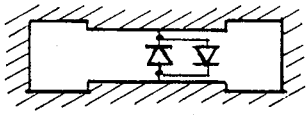
FIG_8-a
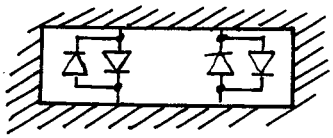
FIG_7
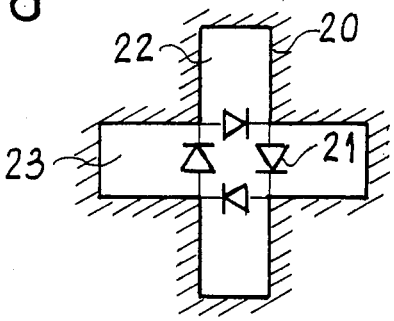
FIG_8-b
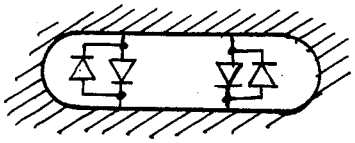
FIG_8-c
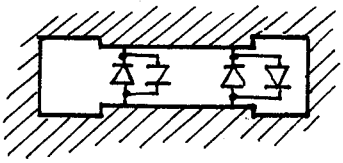

PASSIVE ELECTROMAGNETIC WAVE DUPLEXER FOR MILLIMETRIC ANTENNA

BACKGROUND OF THE INVENTION

The invention relates to a passive electromagnetic wave duplexer.

In a radar system, it is absolutely necessary to protect the radar receiver both against the high level energy emitted by the transmitter and against the energy originating from neighbouring radar transmitters. However, it is highly desirable that the entire energy picked up by the antenna and coming from a target illuminated by the transmitted radiation should be transferred to the receiver without loss. The duplexer thus acts as a switch isolating the receiver during transmission or during a powerful nearby transmission and unblocking the receiver channel during reception of weak signals by the antenna.

There are at present different kinds of duplexers which will be described in the following, but which have the disadvantage that they cannot function or only function poorly with waves in the millimetric ranges. A first kind of duplexer illustrated in FIG. 1 comprises two identical limiters 1 inserted between two 3 dB couplers 51,52, each limiter 1 being unblocked for weak signals but reflective for high power signals. The first coupler 51 is connected to its input side to the transmitter 3 on the one hand and to the antenna 4 on the other hand, whereas its outputs each lead to one of the two limiters 1. The latter are connected to the inputs of the second coupler 52, whose outputs are connected respectively to the radar receiver 5 and to a dissipator load 6. During emission of the radar signal by the transmitter 3, the limiters 1 reflect the same towards the antenna 4 whereas they allow free passage to the weak signals received during reception.

A second kind of duplexer (FIGS. 2*a* and 2*b*) comprising a non-reciprocal ferrite device, operates on the following principle: The signal coming from the transmitter is directed to the antenna and any signal received by the antenna is necessarily channelled to the receiver, notwithstanding its power. FIG. 2*a* shows a duplexer of this nature, comprising two differential dephasing devices 74 and 75, of which the operation is the following: For an initial signal coming from the transmitter 7 and passing through a coupler 71 producing a phase difference $\pi/2$ between the channels 72 and 73, the differential dephasing ferrite device 74 phase shifts the signal of channel 72 by $\pi/2+\rho o$ whereas the other ferrite device 75 phase shifts the signal of channel 73 by $\rho o$. The two signals of which the corresponding phase shifts are $\rho o+\pi/2$ and $\rho o$ lead to a magic T 76 at whose output they are in phase again and are fed to the antenna channel 77. If a signal coming from the antenna 77 is now considered, irrespective of its power, it is dephased by $\rho o$ by the ferrite device 74 and by $\rho o+\pi/2$ by the ferrite device 75, so that the signals respectively emerging from the devices 74 and 75 are in phase again in the receiver after passing through the coupler 71.

As for FIG. 2*b*, it shows a duplexer in which the non-reciprocal device is a three-channel circulator 8. To provide protection for the radar receiver against the high power transmissions of nearby radar transmitters arriving through the antenna, a supplementary limiter cell is added to this kind of duplexer in the reception channel, this cell being formed either by a TR gas tube having a comparatively short life or by ferrite or diode devices.

As stated earlier, these duplexers do not operate satisfactorily with millimetric waves, since the limiter cells described either do not exist for such waves, which is so in the case of TR tubes, or cannot stand up to power satisfactorily, which is the case for existing diodes installed in conventional structures.

SUMMARY OF THE INVENTION

The object of the present invention is to resolve these difficulties by providing a passive duplexer for electromagnetic waves, comprising a first horn connected to the radar transmitter and having propagation axis $\Delta_1$, a plane circular grid which is reflective or transparent as a function of the strength of the incident signals and inclined at 45° with respect to the axis $\Delta_1$, and a second horn connected to the receiver and having a propagation axis $\Delta 2$ at right angles to the axis $\Delta_1$.

According to a feature of the invention, the grid is formed by a dielectric or semiconductor disc metallized on one surface, comprising a network of resonant slots provided with at least one diode, this grid being transparent to weak signals and reflective for high power signals.

According to another feature, the duplexer of the invention comprises several parallel grids.

BRIEF DESCRIPTION OF THE DRAWINGS

Other features and advantages of the invention will appear from the following description, taken in conjunction with the drawings, in which, FIG. 1 shows a first type of prior art duplexer, FIG. 2*a* shows a second type of prior art duplexer, FIG. 2*b* shows an alternative second type of prior art duplexer, FIG. 4 illustrates a plan view of a grid utilized in a duplexer of this nature, FIG. 5*a* shows a rectangular resonant slot used in the plane grid of FIG. 4, FIG. 5*b* shows an oval, resonant slot used in the plane grid of FIG. 4, FIG. 5*c* shows a constricted rectangular resonant slot used in the plane grid of FIG. 4, FIG. 6*a* shows a rectangular resonant slot of FIG. 5*a* having a pair of diodes installed therein FIG. 6*b* shows the oval resonant slot of FIG. 5*b* having a pair of diodes installed therein, FIG. 6*c* shows the constricted rectangular resonant slot of FIG. 5*c* having a pair of diodes installed therein, and FIG. 7 shows a cruciform rectangular slot used in the plane grid of FIG. 4.

DESCRIPTION OF THE PREFERRED EMBODIMENTS

Figure 3:
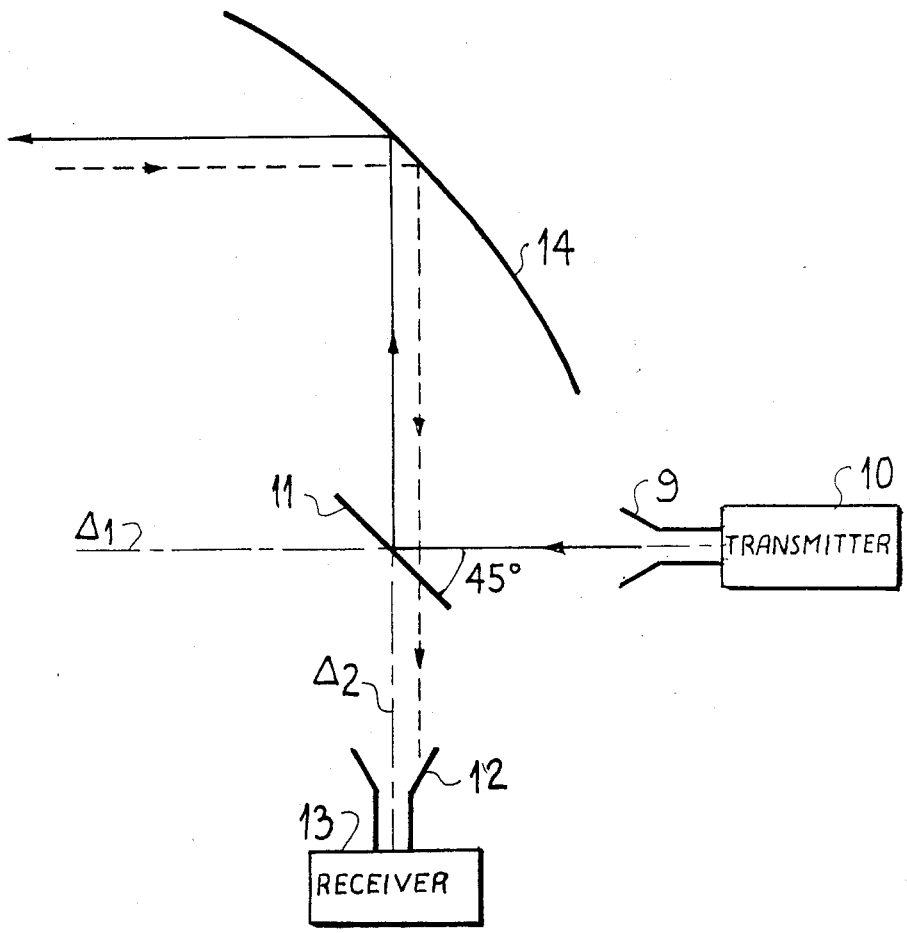
FIG. 3 illustrates a diagram of one embodiment of a duplexer in accordance with the invention.

FIG. 3 shows the diagram of a duplexer according to the invention. It comprises a first horn 9 associated with the radar transmitter 10 directing millimetric electromagnetic waves on to a plane circular grid 11 whose diameter is compatible with operation at millimetric waves, and inclined at 45° with respect to the propagation axis $\Delta_1$ of the horn 9. It also comprises a second horn 12 associated with the radar receiver 13 of which the propagation axis $\Delta_2$ is at right angles to the axis $\Delta_1$, and a transmitting-receiving antenna 14.

The plane grid 11 (FIG. 4) has a reflective or transparent action as a function of the power of the incident signals. In other words, it is wholly reflective for high power signals emitted by the transmitter 10 and wholly transparent to the weak signals received by the antenna 14. It comprises a disc 18 which is either dielectric or a semiconductor but is metallized on one surface 15 in in either case. The metallizing of this surface establishes a network of resonant slots 16 as is apparent from FIG. 4, each being equipped with at least one diode 17. If the disc is of dielectric material, the diodes are inset and then connected to the two opposed edges of the slot. If the disc is of semiconductor material, the diodes 17 are formed directly on the disc.

The duplexer thus constructed operates in the following manner: The radar transmitter 10 feeds a high energy radar signal through the horn 9 which directs the same at the grid 11. Upon receiving this powerful signal, the diodes 17 act as a short-circuit and the slot-diode assembly is detuned, thus making the grid 11 reflective. The grid 11 consequently directs the radar signal to the antenna 14 which for its part reflects the same into space, wholly protecting the radar receiver 13.

Conversely, when the antenna 14 receives a low power signal, it directs the same towards the grid 11. For weak signals however, the diodes 17 are equivalent to capacitances and the slot-diode assembly is adapted to resonate at the operating frequencies. In this way, the network of resonant slots forming the grid 11 is in the passing state for the low level signal which is received satisfactorily by the radar receiver 13 via the horn 12.

Finally, if a transmitter close to the transmitter 10 emits high power microwave signals which are picked up by the antenna 14 and directed towards the grid 11, said grid becomes reflective thus protecting the receiver 13.

The shape of the resonant slots 17 may be rectangular (FIG. 5*a*), oval (FIG. 5*b*) or else may have a constriction 18 at its centre (FIG. 5*c*).

Given the number of slots 16 of the network, the power of the microwave signal distributed throughout the grid by means of the horn 9 or the antenna 14 to each slot and thus to each diode is comparatively small, making it possible to secure a satisfactory resistance to power. This resistance or durability may moreover be considerably improved by connecting, between the two edges of each slot, at least a pair of diodes 19 of identical polarity shunt-connected "head to tail" in a common plane as shown in FIGS. 6*a*,6*b* and 6*c*. In this case, depending on the polarity of the incident microwave signal, it is either the one or the other diode 19 which is conductive, protecting the other diode by limiting the voltage applied across its terminals. FIG. 6 shows a connection of this kind, corresponding to the shape of the resonant slots 16.

For an additional improvement of the duplexer according to the invention, particularly if the microwave signal reaching the grid is polarized in two directions, a network of cruciform resonant slots 20 is formed, such a slot being shown in FIG. 7, each limb 22 and 23 acting as a single slot for one of the two polarizations. For each limb, the diodes 21 are connected head to tail in pairs, but not in the same plane, since they are separated by the width of the other limb.

Finally, a last improvement bearing on the width of the pass band of the system may be made by placing several grids identical to that already described, parallel to each other in such a manner as to form a Tchebisoheff or Butterworth response filter, for example.

For all that which has been described, the grid diameter, the number and the shape of the resonant slots are determined by the characteristics of the diodes, the polarization and strength of the microwave signal which is to be processed.

By means of the duplexer which has been described, the duplexing and protection of the radar receiver against all high power microwave signals are assured, these signals lying within the range of millimetric waves. This device offers the advantage of being passive and of having satisfactory resistance against power since the latter is wholly distributed over a large number of diodes, which may moreover easily be produced and integrated into the grid.

What is claimed is:

1. A passive duplexer for electromagnetic waves, within a radar system comprising a transmitter operating in the millimetric range, a receiver operating in the millimetric range, and an antenna fed by said transmitter and also redirecting electromagnetic signals received from a target to said receiver, comprising:

a first horn adapted to be connected to said transmitter and having a propagation axis $\Delta_1$;

a second horn adapted to be connected to said receiver and having a propagation axis $\Delta_2$ orthogonal to said axis $\Delta_1$; and plane circular grid means formed by a dielectric disc metallized on one surface thereof for reflecting or passing incident signals depending upon the power level of said incident signals, said grid means being inclined at a 45° angle with respect to said axes $\Delta_1$ and $\Delta_2$, said metallized surface having a network of resonant slots for passing said incident signals each slot including a diode in conducting relation thereacross.

2. A passive duplexer for electromagnetic waves, within a radar system comprising a transmitter operating in the millimetric range, a receiver operating in the millimetric range, and an antenna fed by said transmitter and also redirecting electromagnetic signals from a target to said receiver, comprising:

a first horn adapted to be connected to said transmitter and having a propagation axis $\Delta_1$;

a second horn adapted to be connected to said receiver and having a propagation axis $\Delta_2$ orthogonal to said axis $\Delta_1$; and plane circular grid means, formed by a semiconductor disc metallized on one surface thereof for reflecting or passing incident signals depending upon the power level of said incident signals, said grid means being inclined at a 45° angle with respect to said axes $\Delta_1$ and $\Delta_2$, said metallized surface having a network of resonant slots for passing said incident signals each slot including a diode in conducting relation thereacross.

3. A duplexer according to claim 1 or 2, wherein said grid means is wholly transparent to low power electromagnetic signals and wholly reflective to high power signals.

4. A duplexer according to claim 3, wherein each diode is connected to the opposed edges of a corresponding slot.

5. A duplexer according to claim 4, wherein each said resonant slot includes at least one pair of diodes of identical polarity, which are shunt connected anode-to-cathode in one and the same plane.

6. A duplexer according to claim 4, wherein said resonant slots have a rectangular shape corresponding to the polarization of the radar signal which is to be processed.

7. A duplexer acording to claim 4, wherein said resonant slots have an oval form.

8. A duplexer according to claim 4, wherein said resonant slots have a constriction at their centres.

9. A duplexer according to claim 4, wherein said resonant slots are cruciform, each said cruciform slot including four diodes connected anode-to-cathode in pairs.

* * * * *